United States Patent [19]

Mathews

[11] 4,006,545

[45] Feb. 8, 1977

[54] DISPLAY DEVICE

[76] Inventor: William Mathews, 22, Queenscourt, Wembley Park, Middlesex, England

[22] Filed: Apr. 14, 1975

[21] Appl. No.: 567,809

[52] U.S. Cl. ..... 40/36

[51] Int. Cl.[2] ..... G09F 11/30

[58] Field of Search ..... 40/36, 78.07, 78.09, 40/106.1

[56] References Cited

UNITED STATES PATENTS

| | | | |
|---|---|---|---|
| 2,102,798 | 12/1937 | Jerabek | 40/36 |
| 2,209,517 | 7/1940 | Flanagan et al. | 40/36 |
| 2,220,478 | 11/1940 | Curnutt | 40/36 |
| 3,568,345 | 3/1971 | Grosse | 40/36 |

FOREIGN PATENTS OR APPLICATIONS

| | | | |
|---|---|---|---|
| 461,524 | 5/1928 | Germany | 40/36 |
| 177,079 | 8/1935 | Switzerland | 40/36 |

*Primary Examiner*—Hugh R. Chamblee
*Assistant Examiner*—John H. Wolff
*Attorney, Agent, or Firm*—Perry Carvellas

[57] ABSTRACT

A display device for displaying advertisement cards in turn has a pair of inclined surfaces which support a rod attached to each card. The cards slide downwardly and forwardly and the front card is picked up, thereby exposing the next rearward card to view, by a pair of pick-up elements carried by endless loops. The loops are driven round a circuit. Parallel guide rails are provided to preclude tilting of the elements.

7 Claims, 11 Drawing Figures

DISPLAY DEVICE

Figure 1:
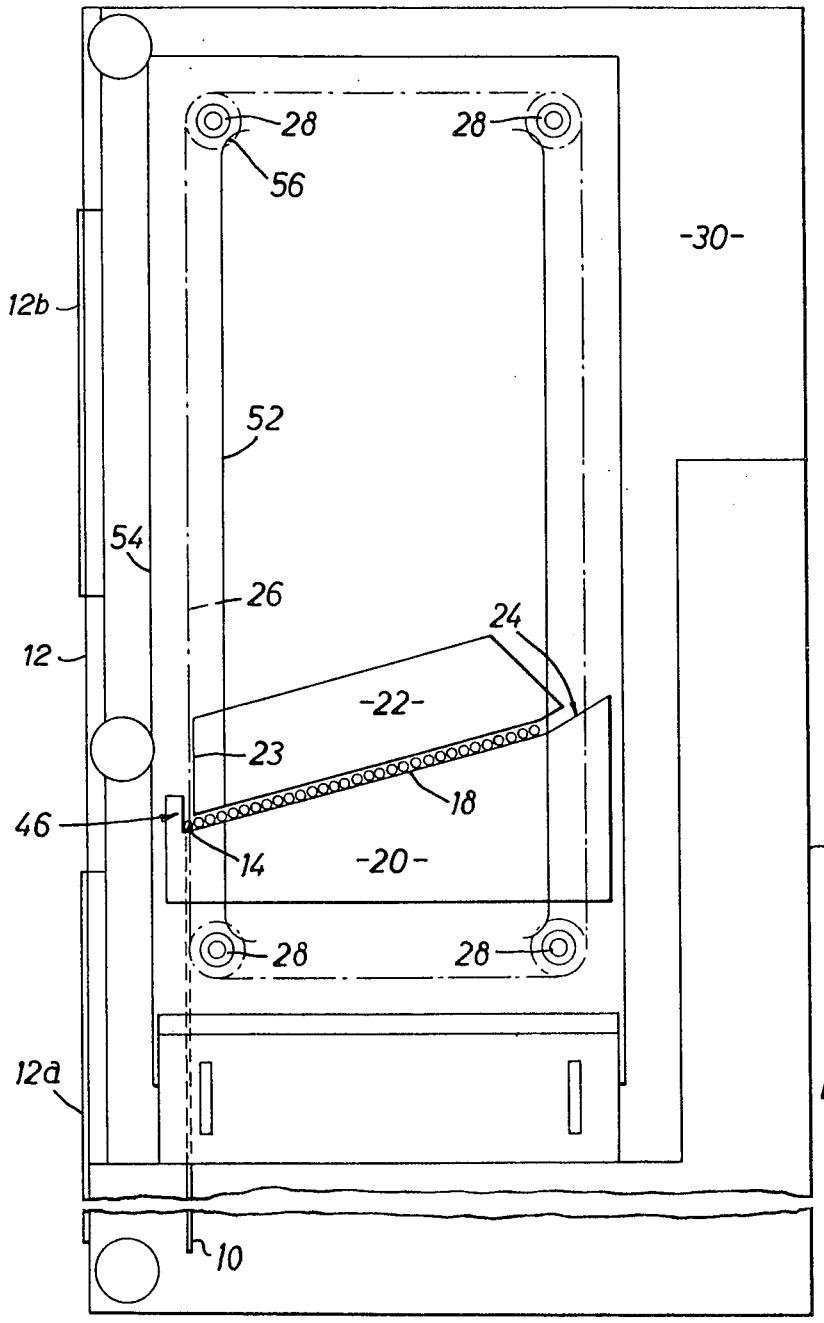

This invention relates to a display device, particularly although not exclusively for displaying a series of pictures or legends, or advertisements or other information. Such devices have been proposed, for example in British Pat. Specification Nos. 389,563, 426,907 and 1,221,442. These devices expose a sheet or card bearing an advertisement or information for a set period, and then a mechanism withdraws this sheet or card and exposes another. Devices for this purpose must be of durable construction and sound design because they are normally installed where maintenance is infrequent and breakdown will cause inconvenience, irritation, or pecuniary loss to the installer. It is an aim of this invention to provide an improved display device one of whose advantages is an ability to display a series of information-carrying members that are relatively stiff and non-flexible. In this Specification, for the sake of brevity and without intention of limitation, such members will be termed "cards."

In accordance with the present invention, there is provided a display device including a series of cards each being the information to be displayed, a support member secured to each card, an inclined surface sloping downwardly and forwardly towards the front of the device and disposed at one side of the device, a corresponding inclined surface disposed at the other side of the device so that an end of the support member can rest on each surface, a pair of continuous loops, one at each side of the device, the loops being controllably drivable in synchronism around suitable guide members defining a circuit, a series of pick-up elements secured to each loop, each element being constructed to be capable of engaging and lifting an end of a support member, and a guide for each series of pick-up elements, shaped and positioned to allow the elements to move around a closed circuit as the loops are driven but substantially to prevent the elements tilting or pivoting relative to their associated guide.

In a preferred form of the invention, each guide is formed by a pair of parallel rails and each pick-up element is a block formed by an assembly having a U-shaped flange in part defining a recess to receive an end of a support member and a groove to receive each rail. The assembly is advantageously made up of a pair of juxtaposed square plates, one of which is rebated around its periphery so that when accurately overlapped with the other plate the resulting square holder has a groove around its periphery.

The support members are preferably rods whose ends are of reduced diameter so that a part of the flange forming an upstanding web of the 'U' can readily enter between two adjacent support members when these are resting on the inclined surfaces.

According to an advantageous and preferred feature of the present invention, provision is made for a double exposure of each card. This may be done by arranging that the front of the display device has two windows or apertures through which the cards can be viewed, one aperture being above the other. The lower window or apertures is arranged to be opposite the front card supported by the inclined surface 18, so that this card can be viewed, and the blocks are driven so that they stop when the card being lifted has cleared the newly-exposed card at the front end of the support surface. In other words, each pair of blocks stops three times on its circuit, once just before it picks up the front display card on the inclined surface 18, once when it has brought this card level with the upper viewing aperture, and once on its return path, half-way between the other two stopping points. The circuit is thus divided into three equal portions. A control unit for the motor is provided to drive the chain, to dwell while the card is exposed, and so on. This control unit includes a microswitch located to be engaged by one of the card-carrying blocks on its return path as aforesaid. This causes the motor to stop.

Figure 2:
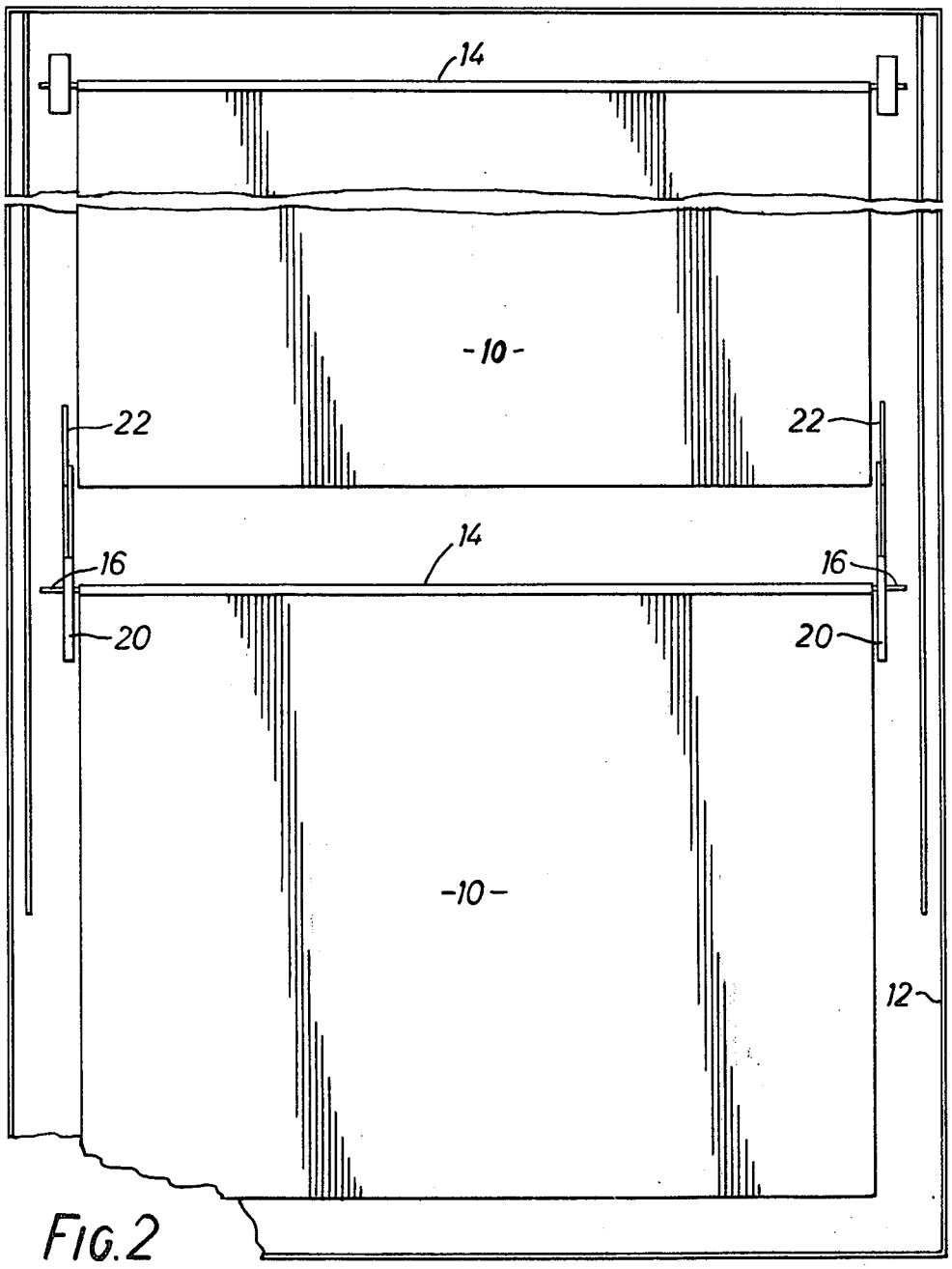
Figure 3:
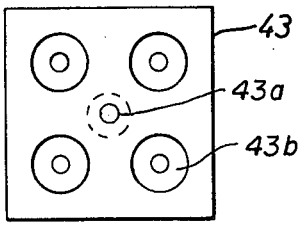
Figure 4:
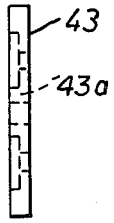
Figure 5:
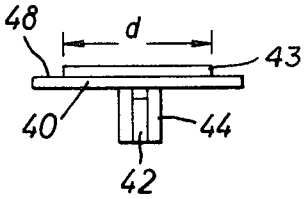
Figure 6:
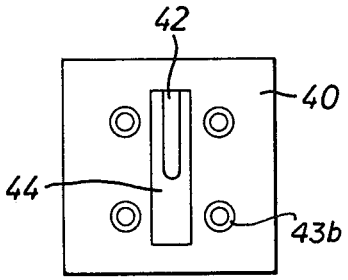
Figure 7:
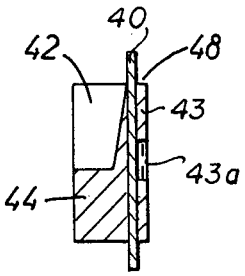
Figure 8:
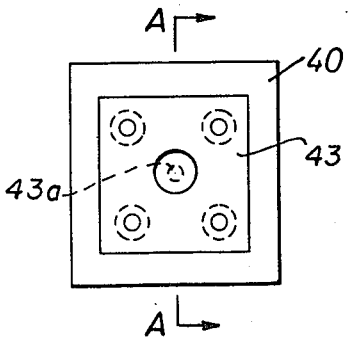
Figure 9:
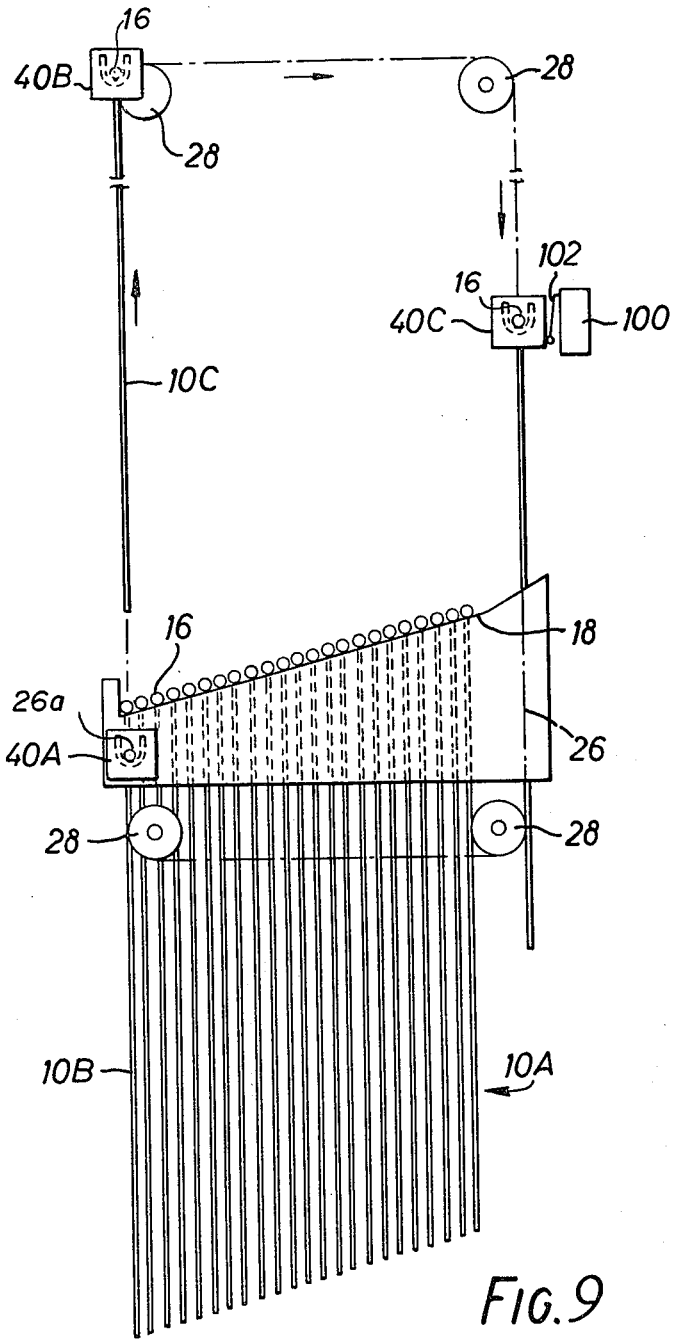
Figure 10:
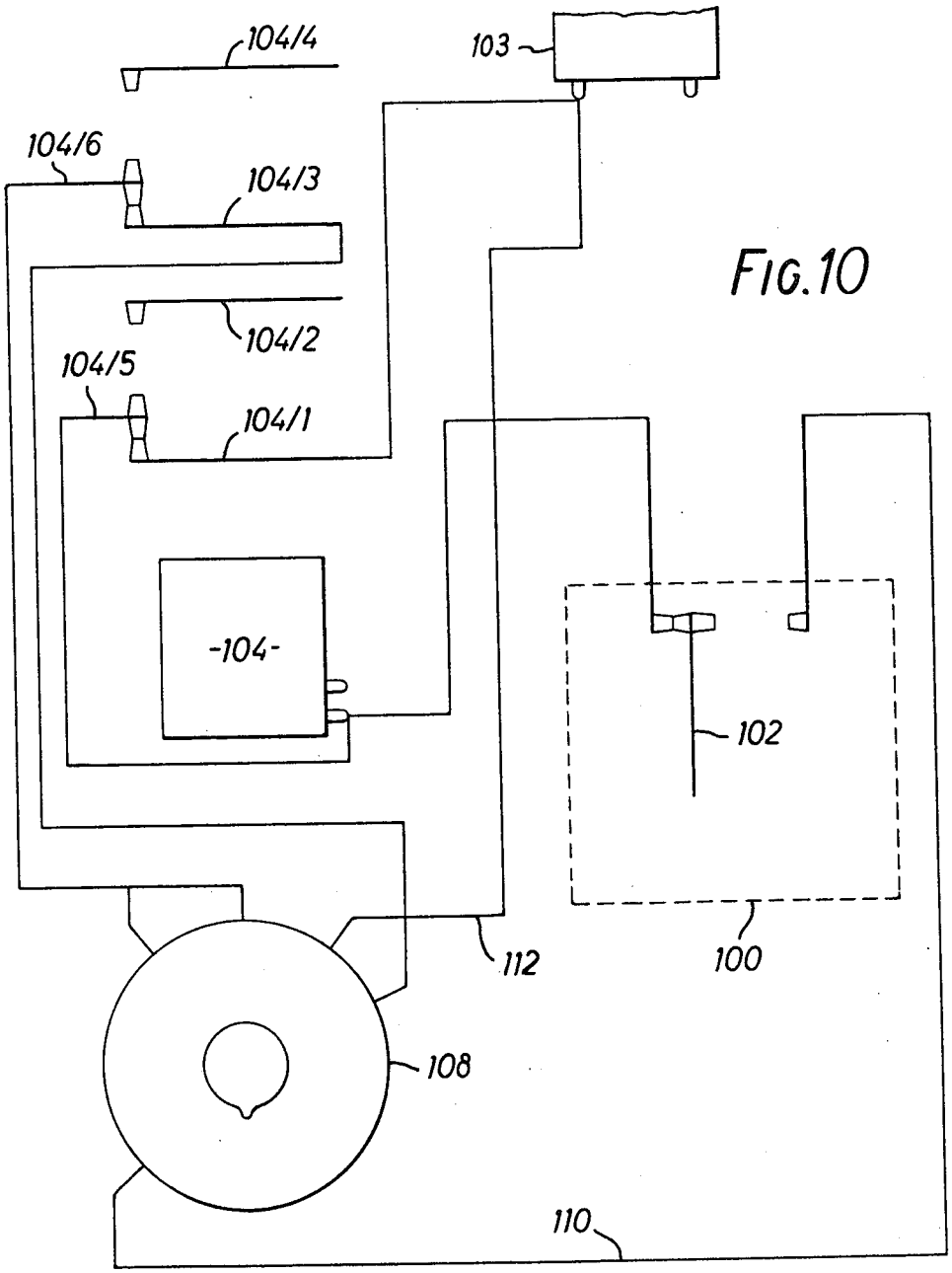
Figure 11:
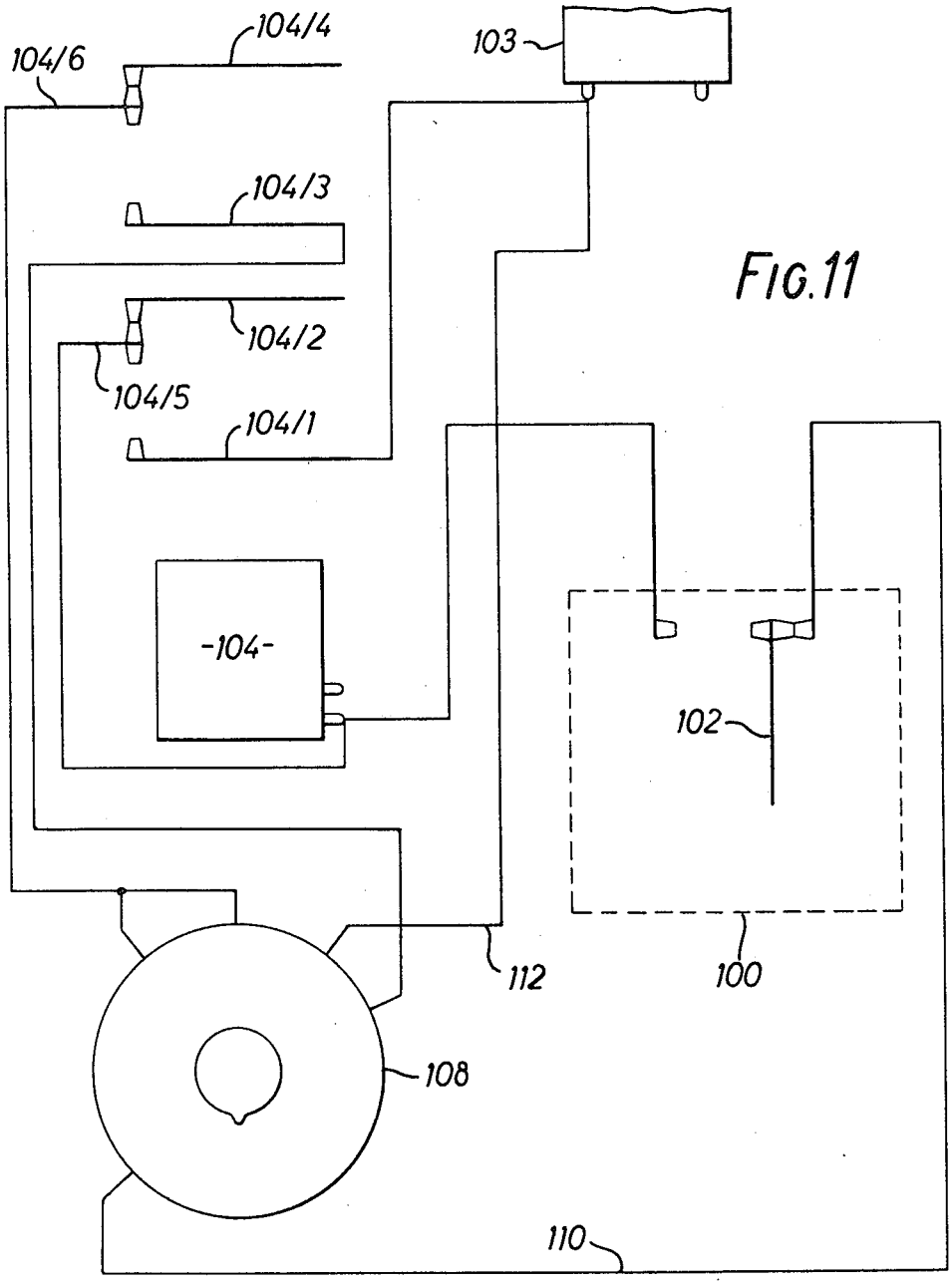

Further features of the invention will appear, and the invention will be better understood, from the following description of an illustrative embodiment, given with reference to the accompanying drawings in which:

FIG. 1 is a diagrammatic side elevation of one form of apparatus in accordance with the present invention, FIG. 2 is a front view of part of the apparatus shown in FIG. 1, FIG. 3 is a front elevation, and FIG. 4 is a side elevation, of a plate which is associated with a pick-up block, FIG. 5 is a plan view of a pick-up block, FIG. 6 is a front elevation of a pick-up block, FIG. 7 is a vertical central section of a pick-up block, and FIG. 8 is a rear elevation view of the block, the section A—A being that of FIG. 7, FIG. 9 is a schematic side elevation of an alternative embodiment of the invention, FIG. 10 is a schematic circuit diagram showing the connections made when the motor is driving the blocks around the circuit; and FIG. 11 is a schematic circuit diagram showing the connections made when a block is engaged with the microswitch, the motor is stopped, and a timer is energised to "time out" the period of dwell for the cards before the motor restarts.

Referring to the FIGS. 1 to 8 of the drawings, the illustrated display device FIG. 1, includes a series of cards of which one is shown at 10. The whole device is enclosed within an outer casing 12 of which a front portion 12*a*is transparent or has an aperture so that the cards 10 can be viewed. Each card 10 is secured to a support member 14 which will usually take the form of a rod having its end 16 extending beyond the lateral confines of the card. In this context, the word "secured" is used to include the case where a card is temporarily secured to the support, for example, by one or more clips or other fasteners. The ends are preferably of a smaller diameter as seen in FIG. 2. The ends 16 of the support members rest on an inclined surface 18 which slopes downwardly towards the front of the device. The surface 18 is formed as an edge of a plate 20 disposed at either side of the device. A further plate 22 serves to define a downwardly sloping guide channel. The front edge 23 of the plate 22 serves to prevent the next rod from being accidently picked up, due possibly to sticking between adjacent rods. The surface 18 has an extension inclined surface 24 which assists in unloading the support members 14 and cards 10 carried thereby from pick-up blocks which will be described in detail later.

The cards 10 are brought to a position where they can be viewed, by an endless closed loop of chain 26, one such loop being disposed at each side of the display device. This chain carries the pick-up blocks referred to. The chain runs around sprockets 28, but equivalent means could obviously be employed, for example an endless band running around guide pulleys. One of the sprockets is driven by an electric motor or other suitable means. The motor may be housed in the portion 30 of the display device casing.

The pick-up blocks are secured at intervals to the chain in any convenient manner, and for this purpose the chain may have a special pin 26*a* FIG. 9, inserted at suitable intervals having a flattened, enlarged head projecting from one side of the chain. This head is trapped in opening 43*a* between a pick-up block 40 (FIGS. 5 – 8) and an associated plate 43 (FIGS. 3 and 4). The two are secured together by bolts, rivets, or other suitable means 43*b*. The pick-up block 40 may be of moulded synthetic plastics material and each has a U-shaped recess 42 defined by a projecting portion 44. The function of the recess 42 is to receive the end 16 of the support member 14 as the pick-up block is driven upwardly by the chain 26, past the region indicated 46, FIG. 1, whereupon the projecting part 44 lifts the end 16. This occurs at each side of the card 10 and accordingly the card 10 is lifted and the next card brought up into a position where it can be viewed through the transparent portion 12*a*.

A particular problem with display devices has been to ensure that the pick-up blocks reliably transport the cards around the loop without allowing them to fall out and yet are always oriented accurately to pick up the next card after the previous card has been unloaded. This involves movement of the pick-up block vertically upwards, horizontally rearwards, and vertically downwards. In the present invention, a guide for each series of pick-up blocks is provided, each guide being shaped and positioned to allow the blocks to move around a closed circuit, but the guides prevent the blocks making any significant tilting movement relative to their initial orientation. This is achieved by having a pair of rails forming the guide, the rails being shown at 52 and 54 in FIG. 1. These rails together form a rectangular channel of which the corners of the inner rails are radiused as seen at 56 in FIG. 1, this radius being equal to the effective radius of the sprocket. The pick-up blocks are square in overall shape, as can be seen from FIGS. 6 – 8, and have a peripheral groove 48 formed by the co-operation of pick-up block 40 and plate 43. The spacing between the rails 52 and 54 is slightly greater than the distance *d* in FIG. 5 so that the pick-up blocks slide smoothly between the rails without any significant tilting movement. Each pick-up block is secured to the chain or band at its centre, with the result that the pick-up block retains its orientation with the recess 42 substantially vertical as the chain carrying the blocks passes around the sprockets 28.

On the descending movement of the chain, the inclined surface 24 which is located at each side of the card 10 engages the ends 16, while the chain continues to descend. The ends 16 are thus lifted out of the recesses 42 and the card and its support member slide down surface 24 onto the inclined surface 18 to await the next time it will be lifted and exposed.

The portion 12*b* of the casing may alternatively be formed by a display panel, optionally illuminated by means not shown, carrying material explanatory of the display cards 10.

Referring now to FIG. 9, like parts carry the same reference numerals as were used in FIG. 1 – 8. FIG. 9 shows pick-up blocks 40, carried around a circuit by a chain 26, although it will be realised that any other continuous member could be used. As illustrated, the chain passes around sprockets 28, but naturally it will be understood that in alternative versions of the invention fixed guide members having a quadrant-shape could be employed, although in this version it may be necessary for these to be continuously lubricated. The illustrated device includes an inclined surface 18, which carries the ends 16 of card-carrying rods 14. The device includes a microswitch 100, having a contact arm 102 that can be engaged and tripped by each pick-up block 40 as it moves downward on the return "rear" part of the circuit. It is disposed so that the linear distance between the pick-up block identified 40A and that identified 40B equals the distance between 40B and 40C and the distance between 40C and 40A. The cards 10A are in their "waiting" position, supported by the inclined surfaces 18, the card 10B is in its exposed position where it can be viewed through the lower window or aperture, and the card 10C is in its exposed position where it can be further viewed (after having been exposed in position 10B) through the upper window or aperture of the display device.

The control unit is arranged to drive the chain a predetermined distance, dwell for a predetermined time while the card 10 is exposed, restart and drive until the next card is in the exposed position, then dwell again, and so on. As an advantageous modification in accordance with the present invention, a proximity switch may be included in the control circuit so that the motor can be started by a person bringing his hand near a predetermined spot. In this way, a person viewing the information displayed on the card 10 can himself control when the next card is presented for viewing, and yet the display device itself can be kept protected, for example behind a plate glass window. The present display device is envisaged as being particularly suitable for Estate Agents, shops selling gramaphone records, and locations where it is desired to display advertisement cards such as are often encountered in corner newsagent shops and the like. It is a particular advantage of the construction according to the present invention that the information displayed can include a photograph or other non-bendable, non-foldable element. Prior forms of display device that have been proposed have not, in general, been able to satisfactorily handle such display material.

It will be appreciated that modifications can be made within the scope of the invention and the present invention is not regarded as limited to the precise details and construction particularly disclosed and illustrated.

I claim:

1. A display device having a viewing aperture, front, back and two sides, including: a series of cards each bearing the information to be displayed, a series of support member each having two ends, each of said cards being secured to a single support member between its ends, means within the device providing an inclined surface sloping downwardly and forwardly towards the front of the device and disposed at one side of the device and a corresponding inclined surface disposed opposite and at the other side of the device such that each of said ends of the support member rests respectively on one of said sloping surfaces, a pair of continuous loops operably connected one at each side of the device, drive means for controllably driving the loops in synchronism around loop guide members defining a circuit within the device, a series of square shaped pick-up elements secured at their centers along each loop, said elements having means for engaging and lifting respective ends of each support member in a manner such that consecutive pairs of said elements are in horizontal alignment, guide means for each series of square shaped pick-up elements comprising parallel guide rails shaped and positioned to allow the pick-up elements to move therebetween and around a closed circuit as the loops are driven but substantially to prevent the elements tilting or pivoting relative to their associated guide means.

2. A device according to claim 1 in which each square shaped pick-up element is secured to the loop by a pin centrally located relative to the block.

3. A device according to claim 1 in which each pick-up element is formed by an assembly having a U-shaped flange in part defining a recess to receive an end of a support member and a groove to receive each pick-up element guide.

4. A device according to claim 3 in which each pick-up element assembly is made up of a pair of juxtaposed square plates, one of which is rebated around its periphery so that when accurately overlapped with the other plate the pick-up element has a groove around its periphery.

5. A device according to claim 1 in which the support members are rods whose ends are of reduced diameter so that a part of the flange forming an upstanding web of the 'U' can readily enter between two adjacent support members when these are resting on the inclined surfaces.

6. A display device according to claim 1 in which a front casing thereof has two apertures or areas through which the cards can be viewed, and each card is, in use, first exposed to view through the lower and secondly through the upper aperture or area.

7. A display device according to claim 1 which includes a control system arranged to: drive the loops a predetermined distance around the circuit, dwell for a predetermined time while each card is displayed, restart, and drive the loops a further predetermined distance thereby exposing the cards to view in turn.

* * * * *